US005188052A

United States Patent [19]

Breuer

[11] Patent Number: 5,188,052

[45] Date of Patent: Feb. 23, 1993

[54] TRANSPORTER UNIT FOR ADJUSTING A GENOA LEAD BLOCK AND CAR

[76] Inventor: Rudi A. Breuer, 2601 Palma Drive, No. 8, Ventura, Calif. 93003

[21] Appl. No.: 656,311

[22] Filed: Feb. 15, 1991

[51] Int. Cl.[5] ..... B63H 9/10

[52] U.S. Cl. ..... 114/204; 74/424.6

[58] Field of Search ..... 114/204, 205, 112, 102; 74/424.6

[56] References Cited

U.S. PATENT DOCUMENTS

| | | | |
|---|---|---|---|
| 2,453,357 | 11/1948 | Barkley | 114/111 |
| 2,490,307 | 12/1949 | Karr | 74/424.6 |
| 3,534,700 | 10/1970 | Marshall | 114/204 |
| 3,678,876 | 7/1972 | Aher | 114/204 X |
| 4,013,031 | 3/1977 | Viviano | 114/204 |
| 4,719,869 | 1/1988 | Harken | 114/102 |

*Primary Examiner*—Sherman Basinger
*Attorney, Agent, or Firm*—Jessup, Beecher & Slehofer

[57] ABSTRACT

A transporter unit is used for abutting against a genoa car or lead block on a track on the starboard or port side of a deck of a sailboat to lock or move the lead block to adjust the jib sheet angle while sailing. The unit is slidably engageable on a modified track having a series of gear grooves to mate with a worm gear mounted on the unit. The unit is moved on the track by turning a shaft with an attached worm gear mounted in the unit. The worm gear cooperates with the track. The unit has a slidable carriage. The bottom of the carriage has a channel which mates with the modified track. The top of the carriage has a rectangular cavity onto which is mounted a rectangular housing. The cavity on the top of the carriage has a rectangular opening to provide access to the track for the worm gear. The carriage has a pair of inboard and a pair of outboard knuckle projections. There is a common bore through the inboard knuckles and the housing into which a quick release pivot pin is secured. The outboard knuckles and the housing have a common bore into which a pivot pin is secured. The housing is openable and closable. The underside face of the housing has a rectangular cavity. There is a medial bore in the underside for mounting the rotatable worm gear and shaft.

7 Claims, 3 Drawing Sheets

TRANSPORTER UNIT FOR ADJUSTING A GENOA LEAD BLOCK AND CAR

BACKGROUND OF THE INVENTION

1. Field of the Invention

SHIPS: SAILS AND RIGGING; Running Gear. TRAVELERS; Tension Relievers; Sail Trimmers.

2. Description of the Prior Art The quest for speed is the ultimate goal in many sports. This is also true in sailboating and racing, which is a growing and organized sport. A sailboat's sailing speed can be increased through improved hull design and sail technology, among other things.

The sail trim is a direct major influence on maximum boat speed. The headsail (genoa) trim is achieved by proper tension of the headstay or backstay and halyard, and in the case of a genoa also the location of the "genoa lead block" is important. All of these factors are influenced by wind velocity, point of sail, and wind direction. The adjustments are ongoing during a race, particularly with sheets (ropes) being under stress-loaded conditions as well as all gear. The sailor must be able to make optimum adjustments during these conditions in order to stay competitive in a race. Gear reliability is also a major concern during the race and must never be neglected.

Going upwind, for instance, will require a genoa block adjustment that is different than the one the sailor would use in a beam reach or a broad reach. All these adjustments resulting in sail attitude change can occur on the same tack under constant loaded sheet conditions. In order to stay speed effective, the sailor must change the sheeting angle of his lead block to his new genoa attitude. This lead block adjustment is needed to maintain optimum speed at a particular point of sail in relation to wind direction of the craft. The sailor may want to power up or spill wind in order to keep the sailboat on a flatter heel for better performance.

With my new invention, all these things can be achieved with the change of sheeting angle of the genoa or headsail lead block while underway by moving it forward or backward from micro to major proportions.

Any skipper familiar with sail trim will more often than not sail beyond his handicap to beat out the competition every time.

On larger crafts, these lead block changes could not be achieved without such mechanical help during optimum loaded conditions, unless the skipper would be willing to put the boat in "almost" irons position or change tack and then make the lead block change under no-load conditions and again come back to the original tack, and hopefully continue under optimum conditions if all goes well.

This option can be used but will probably result in a loss of position which is not desirable, when constant speed is of paramount importance.

SUMMARY AND OPERATION OF THE INVENTION

A transporter unit is used for abutting against each existing genoa lead car or lead block on a track on the starboard and port side on a deck of a sailboat to lock or move the block or lead car to adjust the jib sheet angle while sailing. A genoa lead car is also called a lead block. Both terms are used interchangeably, and refer to the same piece of equipment. The unit is slidably engageable on a modified track having a series of gear grooves to mate with a worm gear mounted in the unit. The unit is propelled on the track by turning a shaft with an attached worm gear mounted in the unit. The worm gear cooperates with the track. The unit has a slidable carriage. The bottom of the carriage has a channel which mates with the modified track. The top of the carriage has a rectangular cavity into which is mounted a rectangular housing. The cavity on the top of the carriage has a rectangular opening to provide access to the track for the worm gear. The carriage has a pair of inboard and a pair of outboard knuckle projections. There is a common bore through the outboard knuckles and the housing into which a pivot pin is secured. The housing is openable and closable and pivots about the axis of the pivot pin. The underside face of the housing has a rectangular cavity. There is a medial bore in the underside for mounting the rotatable worm gear and shaft. The inboard knuckles and the housing also have a common bore into which a quick release pin is secured.

Expressed another way, the present invention is used on a sailboat to adjust the angle on the jib sheet in a front to back motion. A modified track having grooves for a worm gear is mounted either on the starboard side or the port side of the deck of the boat, on top of the conventional track, bow to stern location, or the conventional track is removed and replaced with the modified track having the gear grooves. The original genoa car and/or lead block are still kept on the new track, and used with the invention. The present invention is mounted aft of the genoa car and/or lead block and is used to force the genoa car and/or lead block forward or let it follow aft on the track causing adjustments in sheeting angle, or stop anywhere to automatically fix the car at a particular location on the track regardless of pin and hole location.

The present invention is comprised of a slidable rectangular-shaped carriage, a rectangular-shaped openable and closable housing which is pivotally mounted on the top of the carriage, and a worm gear and shaft mounted in the openable and closable housing. The upper midsection of the top of the carriage has been removed to form a rectangular parallelepiped-shaped area with a pair of opposed transverse walls and a flat planar surface. There are also four knuckle projections located on the top with one at each of the four corners of the carriage. The pair of knuckle projections on the inboard side has a common bore drilled therethrough and the pair of outboard side knuckle projections also has a common aligned bore drilled therethrough. The openable and closable housing has such dimensions that it fits closely on the planar surface and in the rectangular cavity milled away from the top surface of the carriage. The openable and closable housing has a bore drilled therethrough on the inboard side and also another bore drilled therethrough on the outboard side. Both bores are parallel and positioned lengthwise in the openable and closable housing. A pivot pin is positioned in the pair of outboard knuckle projections. The other inboard lengthwise bore on the openable and closable housing is aligned with the common bore of the pair of inboard knuckle projections so that a quick release locking pin can be inserted into the two sets of aligned bores to lock the openable and closable housing in the closed operable mode on the carriage. The quick release locking pin has a quick release button to allow the pin to be quickly removed to allow the housing to be swung open. The unit is now ready to be opened and closed.

The top planar surface on the carriage formed by the rectangular parallelepiped cavity has a rectangular opening cut through it exposing the worm gear grooves and a portion of the track. The bottom of the carriage has a T-shaped channel cut therethrough medially and lengthwise on the carriage. The rectangular opening interrupts the middle of the channel and divides the channel into a fore and aft section. This T-shaped channel is of such dimensions that the carriage can be slid onto the track, which also has a T-shaped cross section. The T-shaped track and T-shaped channel on the carriage allow the carriage to slide back and forth between the ends of the track.

The openable and closable housing is a generally rectangular-shaped box with a transverse rectangular parallelepiped area milled away from the underside face of the openable and closable housing and extending the entire width of the underside face. This cavity creates an inverted U-shape appearance at any longitudinal cross-sectional view of the openable and closable housing. The ends or legs of the U-shaped area form a pair of fore and aft upright opposed transverse braces for mounting the rotatable shaft and worm gear combination to the housing. There is a bore drilled medially and lengthwise through the aft upright brace and terminating in the forward brace of the openable and closable housing for allowing a rotatable shaft and worm gear to be mounted on the underside face of the openable and closable housing.

There is a worm gear having a concentric bore of such dimensions that the worm gear can slide over and fit snugly on the rotatable shaft. The worm gear fits in the cavity between the upright braces on the bottom of the openable and closable housing. The shaft has a slot, or keyway, and also the worm gear has a complementary slot, or keyway, to allow a key to be inserted to lock the worm gear on the rotatable shaft so that the worm gear and rotatable shaft will rotate in unison. The shaft, gear, and components are locked between the upright braces by an annular groove in the shaft and harnessed by a split lock ring mounted on the annular groove. The exposed aft end of the rotatable shaft has a hexagonal head to allow, for example, a bidirectional ratchet wrench or the chuck of a cordless drill to be snapped onto the end to allow the rotatable shaft to be rotated rapidly either clockwise or counterclockwise with the bidirectional ratchet wrench causing the unit to move forward or backward. The end of the shaft opposite the hexagonal end can be flat or cone-shaped. This end of the shaft is secured in the cylindrical cavity partially drilled into the forward inside upright brace of the housing. This cylindrical cavity holds the other end of the rotatable shaft in place so it will not move about. The aft brace has a through hole of the same diameter as the shaft diameter for shaft insertion and to allow extension of the shaft to mate with the wrench. The worm gear is fully compatible with the worm gear grooves made in the track. When the openable and closable housing is closed and the quick release locking pin is inserted, the worm gear meshes with the gear grooves on the track. By rotating the rotatable shaft and the attached worm gear, the transporter unit is caused to advance forward or aft on the track. As previously stated, the genoa car or lead blocks are positioned forward of the carriage. In the loaded mode, the genoa block constantly maintains a force pushing towards the stern of the boat because of the angled jib sheet passing through the genoa car or the lead block.

The openable and closable housing is pivotally mounted front to back on the carriage so that the quick release locking pin can be removed and the openable and closable housing can be opened up so that the present invention can be quickly removed from the track and stowed away, or quickly adjusted (no load) on the track to roughly align it adjacent to the desired genoa car or lead block position. This eliminates turning the shaft, which limits the speed at which the present invention can traverse back and forth on the track. As stated, the pivot mechanism and quick release locking pin allows for quick adjustment of the genoa block, when needed, under no-load conditions.

Under load, the sailor can adjust the angle on the jib sheet and therefore the jib sail by moving the present invention forward or aft on the track to adjust the genoa car or lead block any given distance. In the prior art devices, the tension on the jib sheet caused by the wind blowing on the jib sail is so great that it is a very difficult task to move the genoa car or lead block along the four inch increments that the conventional tracks allow for. By placing the present invention adjacent to the genoa car or lead block, this effectively acts as a positive locking point anywhere for the genoa car, and it also allows the sailor to move the genoa car and block in fractions of inches with ease compared to the conventional method of moving the genoa car and block by strong physical exertion often performed by three crew members.

Accordingly, it is the object of the present invention to provide a device to adjust the genoa car or lead block on a track in various stages and also to provide a device to positively stop the genoa car and block at any position on the track, operable by one person safely.

The present invention is far superior when compared to the prior art block and tackle adjuster. The prior art and the stretching lines are only a compromise to the exact position where the genoa car or lead block could be positioned.

In contrast, the present invention has a "stop anywhere"precise adjustment either forward or backward. The worm gear simply engages the track that has been modified with gear grooves cut in its surface perpendicular to the direction of travel. The present invention gains traction by turning the worm gear that cooperates with the gear grooves.

The present invention prevents an accidentally rapid genoa sheet release that can send shudder through the rigging when the genoa is under potentially heavy loads. The block and tackle version disclosed in Harken U.S. Pat. No. 4,719,869 issued on Jan. 19, 1988 is not fail-safe in this regard. The line may be accidentally tripped from its jamb cleat and cause a potential mishap.

The present invention can be adjusted at any stage, under great load when in use, or disengaged for rapid change in both directions by simply pulling a quick release pin under load free conditions. The invention eliminates the need to tack the boat. Generally the genoa car or lead block can be off its most "advantageous position" only by a few inches or so. All these conditions and more can be met by the present invention as well or better than the prior art devices.

In the marketing of the present invention, the product will be able to be retrofitted on boats already built as well as original equipment on new sailboats. The present invention must be mounted in symmetrical fashion on the port and starboard side.

DETAILED DESCRIPTION OF THE PREFERRED EMBODIMENT

Figure 1:
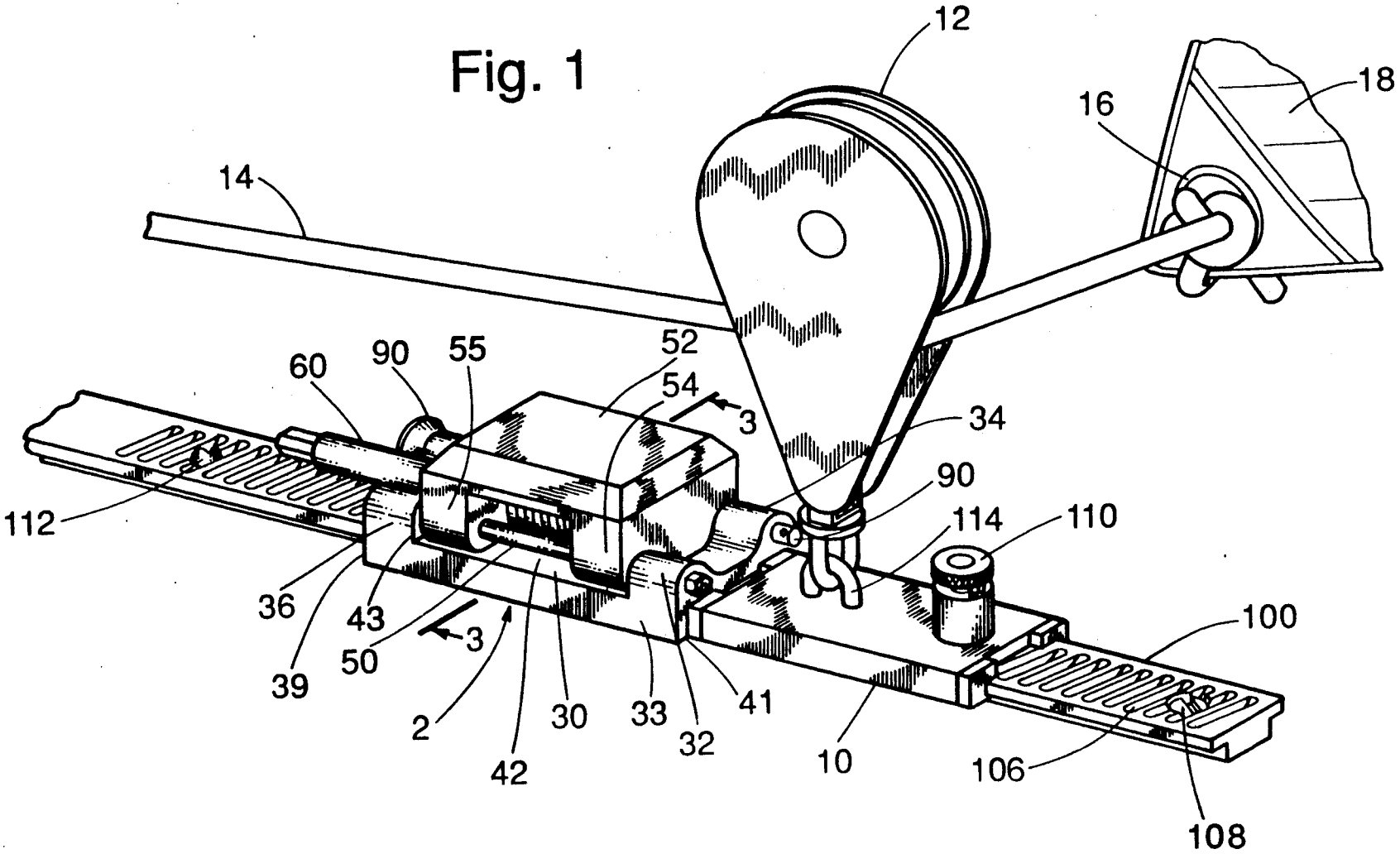
FIG. 1 is a perspective view of the transporter unit made in accordance with the present invention. The view is from the perspective of the sailor positioned outboard of the deck of the starboard side of a sailboat with the present invention mounted on the deck on the starboard side. It is illustrated as slidably engaging a track on the deck. The boat owner's existing car with a genoa block, which is not part of the invention, is also engaged on the track, and is located adjacent to and forward of the present invention. One end of the jib sheet is leading to the aft starboard side winch of the sailboat, the middle is passed through the genoa block and the other end is tied to the clew of a genoa jib sail.

Referring now to FIG. 1, the present transporter unit invention labelled 2 is illustrated in the typical environment in which it will be used. This view is illustrated from the perspective of the sailor positioned outboard of the sailboat and looking towards the starboard or right-hand side of the hull of the sailboat. The modified track 100 is secured to the top of the deck, or secured to the top of an existing track.

The present invention is illustrated FIG. 1 engaging with the modified track 100, and is in the closed operative mode. Towards the front (right side of illustration), or bow of the present invention, the genoa car 10 and block 12 are illustrated, which are not considered to be part of the invention. There is also shown the jib sheet 14, or rope, passing through the block 12 and secured to the clew 16 of the foot of the jib sail 18.

Figure 2:
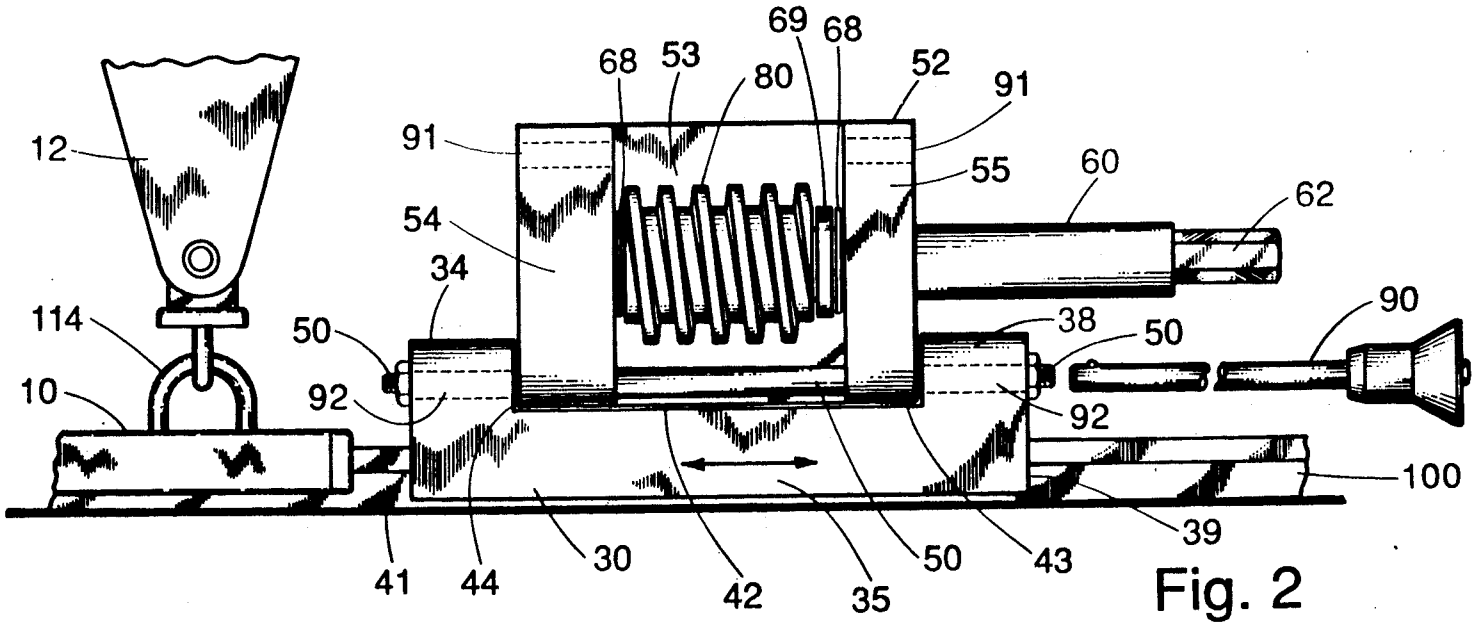
FIG. 2 is a side elevational view of the present invention with the release pin removed, and the openable and closable housing in the open unloaded position for rapid major adjustment or for stowaway. This view is from the sailor's perspective in the cockpit and viewing the inboard side of the present invention secured to the starboard side of the deck.

FIG. 2 illustrates another view of the present invention in the open unloaded position for rapid major adjustment or stowaway. FIG. 2 is illustrated from the sailor's perspective in the cockpit and viewing the inboard side of the present invention secured to the starboard side of the deck. FIG. 2 illustrates the invention in a reverse angle from that illustrated in FIG. 1.

There is shown in FIG. 2 the basic components that comprise the invention. The basic components are: a slidable carriage 30; an openable and closable housing 52; a pivot pin 50; a rotatable shaft 60; a worm gear 80; a removable quick release locking pin 90; and a track 100.

Figure 3:
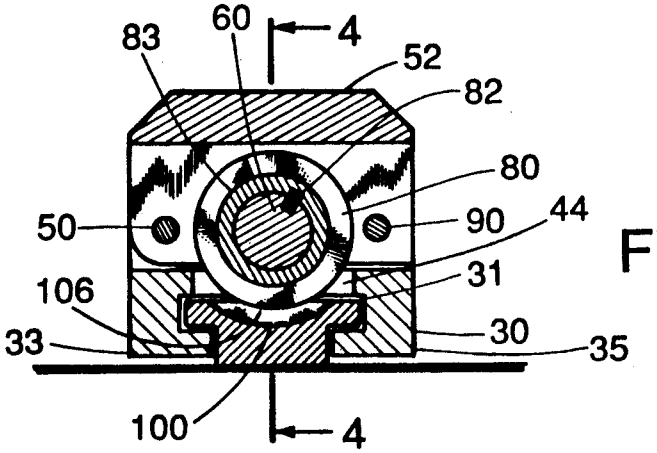
FIG. 3 is a transverse sectional view of the invention taken along line 3—3 in FIG. 1.

The slidable carriage 30 is shown in the cross-sectional view in FIG. 3. The slidable carriage has the overall appearance of an elongate rectangular box. The outboard elongate edge is labeled 33, and the inboard elongate edge is labeled 35. Both edges 33 and 35 are symmetrical. The aft transverse edge is labeled 39, and the forward transverse edge is labeled 41. The prototype carriage was initially fabricated from extruded aluminum. The present invention can be fabricated and machined from any type of a marine environment friendly material. The bottom of the carriage is flat and rectangular-shaped and has a medial longitudinal T-shaped channel 31 cut therethrough for cooperating with the track 100, which is also T-shaped in cross section. The end of the T-shaped track 100 is visible in FIG. 1. Before the carriage is milled, the top surface of the carriage adjacent each of the two elongate edges 33 and 35 has a hemicylindrical projection running lengthwise. The top of the carriage forms a generally sinusoidal surface when viewed from either transverse end 39 or 41 of the carriage. There is a trough formed lengthwise and medially on the top surface of the carriage between the two parallel hemicylindrical projections. A planar surface is formed on the top by removing a portion of the surface between the transverse ends 39 and 41 of the carriage 30. The top of the carriage is milled transversely and the cut planar surface 42 extends the full width of the carriage and is centered between the transverse ends 39 and 41 of the carriage 30. The top of the carriage is milled away to about half the depth of the sides of the carriage to form the planar surface 42 and transverse abutting walls 43 and 44. This machining process also removes most of the hemicylindrical projections leaving four knuckle projections 32, 34, 36 and 38 on the top of and at each corner of the carriage. The horizontal flat planar surface 42 is positioned generally equidistant between the pairs of knuckle projections 32–34 and 36–38 and the transverse ends 39 and 41. The two knuckles 34 and 38 on the inboard side 35 of the carriage 30 have a common aligned bore 92 drilled lengthwise through both of them. The other two knuckles 32 and 36 on the outboard side of the carriage also have a common aligned bore drilled lengthwise through both of them, as is the housing.

As illustrated in FIG. 2, the common bore 91 in the housing 52 is aligned with the common bore 92 in the carriage so that both bores 91 and 92 match up when the housing is shut to allow the quick release pin 90 to enter both common bores to hold the housing locked in place on the carriage. The other pair of common longitudinal bores on side 33 are also aligned when the housing is positioned on the carriage to allow the pivot pin 50 to be inserted and secured in the common bores with nuts threaded on to each end of the pivot pin 50. Both sets of inboard and outboard common bores are preferably of the same dimensions so that the invention can be mounted either starboard or port side by the simple process of switching the pivot pin 50 with the quick release pin 90 and quick release button 92. It is preferable that the housing pivot pin 50 occupy the outboard side of the unit. This is the most efficient way to mount the openable and closable housing.

The planar surface 42 has a rectangular opening 44 cut into it. The rectangular opening is visible in the cross-sectional view of FIG. 3. The rectangular opening 44 is centered somewhat on the planar surface 42.

The slidable carriage 30 can travel back and forth between the ends of the track 100. The carriage has a cutaway portion defined by the planar surface 42 and the two transverse walls 43 and 44 on the top for allowing the openable and closable housing 52 to closely occupy the space described as the cutaway portion. The cutaway portion also allows one of the longer sides of the openable and closable housing 52 to be pivotally secured to one of the elongate sides 33 or 35 of the carriage. The drawings illustrate the openable and closable housing 52 as being pivotally or hingedly secured to the outboard edge 33 of the carriage. This is the preferred edge to allow the sailor to lift the housing from the inboard side. The cutaway portion is the result of the previously mentioned milling process. As illustrated in FIG. 2, there is a pivot pin 50 extending through both the openable and closable housing 52 and the carriage 30 to allow this pivoting ability. The openable and closable housing 52 is shown in the open position in FIG. 2. The openable and closable housing is a generally rectangular-shaped box with a transverse rectangular parallelepiped area 53 milled away from the underside face of the openable and closable housing and extending the entire width of the underside face. The underside face is visible in FIG. 2. This cavity 53 creates an inverted U-shape appearance at any longitudinal cross-sectional view of the openable and closable housing 52. The ends or legs of the U-shaped area form a pair of fore 54 and aft 55 upright opposed transverse braces for mounting the rotatable shaft 60 and worm gear 80 combination to the housing. There is a bore 56 drilled medially and lengthwise through the aft upright brace 55, and terminating as a cylindrical cone-shaped cavity 57 in the forward brace 54 of the openable and closable housing for allowing a rotatable shaft and worm gear to be mounted on the underside face of the openable and closable housing. The bore 56 and cavity 57 are made, for example, by a rotating drill bit. The cone shape at the end of the cavity 57 reflects the cutting angle of the tip of the drill bit and does not serve a function. The cylindrical portion of the cavity 57 functions to anchor the tip of the shaft 60 and to allow it to rotate.

There is a worm gear 80 having a concentric bore 83 of such dimensions that the worm gear can slide over and fit snugly on the rotatable shaft 60. The worm gear 80 fits in the cavity 53 between the upright braces 54 and 55 on the openable and closable housing 52. The concentric bore 83 of the worm gear 80 has a slot or keyway and the shaft 60 has a complementary slot or keyway to allow a key 82 to be inserted to lock the worm gear on the rotatable shaft so that the worm gear and rotatable shaft will rotate in unison. The exposed aft end 62 of the rotatable shaft 60 has a hexagonal head to allow a bidirectional ratchet wrench to be snapped onto the end to allow the rotatable shaft to be rotated rapidly either clockwise or counterclockwise with the bidirectional ratchet wrench or other suitable tool. The end of the shaft opposite the hexagonal end has a conventional flat circular head. This head of the shaft is secured in the cylindrical cavity 57 drilled into the forward upright brace 54 of the housing. This cylindrical cavity 57 holds the forward end of the rotatable shaft in place so it will not move about. Bearings could be positioned in the cavity 57 and bore 56 to allow the shaft to rotate more easily. The shaft is held in position between the upright braces 54 and 55 of the housing 52 by a split lock ring 69 fitted into an annular groove (not visible in the drawings) on the shaft about midway between its ends. Self-lubricating washers 68 are mounted on the shaft adjacent to the braces 54 and 55 for smooth operation.

Figure 4:
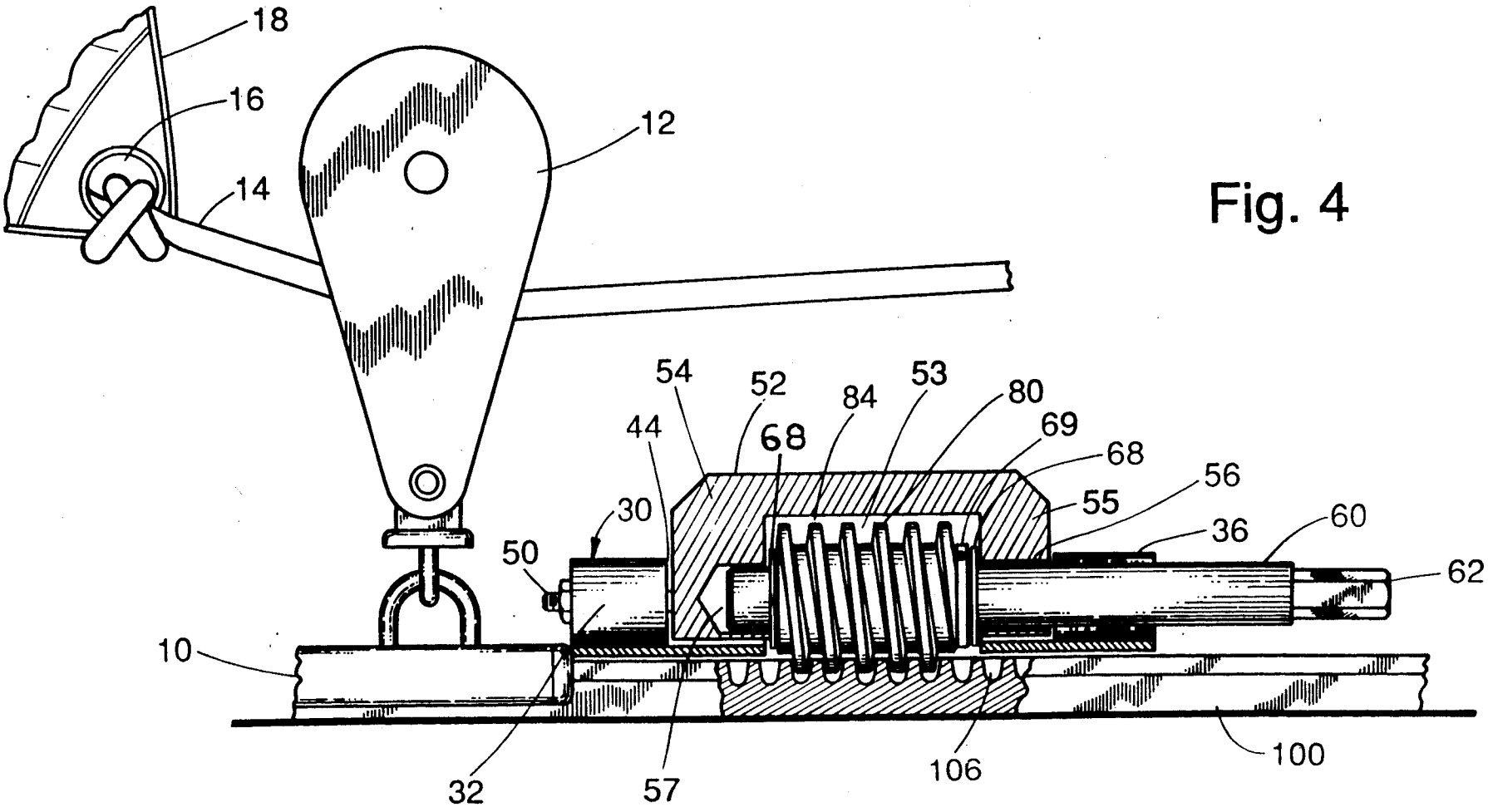
FIG. 4 is a partial longitudinal sectional view of the invention taken along line 4—4 in FIG. 3 with portions of the base, the openable and closable housing and the track cut away for clarity. The worm gear and shaft are not affected by the cutaway.

The worm gear 80 is fully compatible with the worm gear grooves made into the track. When the openable and closable housing 52 is closed and the locking pin 90 is inserted, the worm gear mates with several of the gear grooves on the track. The worm gear 80 is held in place in the openable and closable housing 52 by the rotatable shaft 60, which is slipped into place as shown in FIG. 4. The worm gear 80 is a conventional worm gear and has a concentric bore 83 therethrough of sufficient diameter to allow the rotatable shaft 60 to pass through. There is a certain amount of tolerance between the aft end of the worm gear 80 and the aft brace 55 on the openable and closable housing 52. There is an annular groove, which is not visible in the drawings, cut in the rotatable shaft so that a retaining collar 69 can be secured at this point to retain the worm gear 80 and the rotatable shaft 60 as well as the self-lubricating washers 68 in position on the openable and closable housing 52. The teeth 84 comprising the worm gear are compatible with the gear grooves 106 cut into the track 100 so that when the worm gear 80 is rotated, it will cooperate with the gear grooves cut in the top of the track to cause the present invention to move fore and aft on the track 100.

The aft end of the rotatable shaft has a hexagonal cut head 62 somewhat like a bolt head so that a removable reversible ratchet wrench or similar cranking device (not shown) can be demountably snapped onto the head 62 of the shaft 60. The reversible or bidirectional ratchet wrench is designed to cause the shaft to rotate clockwise or counter clockwise thereby causing the present invention to travel forward or backward on the track 100 when the shaft is rotated clockwise or counter clockwise. The present invention will not move on the track, unless the shaft is rotated, because the teeth on the worm gear and the gear grooves in the track are perpendicular to the travel path of the invention on the track. The constant pressure exerted against the forward end of the present invention by the genoa car forces the worm gear teeth against the track gear grooves in a direction perpendicular to the teeth and grooves. This pressure prevents the worm gear from rotating by itself. Before operating the invention, the housing 52 must first be closed and locked with the locking pin. The locking pin 90 has a quick release button that depresses a knob projection on the shaft of the locking pin.

The whole purpose of the present invention is to control movement under any high wind conditions of the genoa car or lead block that abuts against the forward transverse end 44 of the present invention. As stated in the background of the invention, one current practice is to allow the genoa lead block to move incrementally along the track by pulling up on the locking pin 110 shown in FIG. 1 to release the car 10 to allow it to move. There are holes 112 spaced about 4 inches apart on the conventional track to allow the block to move at 4 inch increments. The main difficulty of the prior art device is that in order to move the genoa lead block, the tension on the jib sheet has to be relaxed in some way. This could be an impossible task on a medium-sized yacht and basically the sailor has to change the direction of the boat to cause the headsail to depower to provide some slack on the jib sheet so that the genoa car and block can be moved incrementally in about four inch segments along the prior art track on a typical sailboat. This is a practice often impossible with boat traffic nearby.

The present invention is mounted on a conventional track, which has been modified by having transversely angled gear grooves cut into its top surface. The invention can travel back and forth on the modified track by rotating the shaft, which in turn rotates the spiral teeth 84 on the worm gear 80 causing the worm gear 80 to cooperate with the gear grooves 106. Since the worm gear 80 and shaft 60 are mounted in the housing 52 and are part of the invention, the invention with its worm gear 80 moves as one unit. The sailor can rotate the shaft 60 one direction with a ratchet wrench causing the present invention to inch forward while pushing the genoa car and block forward. Or the sailor can rotate the shaft the opposite direction to move the invention aft. The genoa car and block will then follow aft to give way to adjust the angle on the jib sheet 14 thereby adjusting the jib sail. By having a sailboat equipped with the present invention, the tension on the jib sheet does not hinder the sailor when adjusting the jib sail. The sailor can safely rotate the rotatable shaft clockwise or counterclockwise thereby moving the genoa car 10 and block 12 forward of aft thereby ultimately changing the attitude of the jib sail 18. The jib sheet 14 maintains a constant tension on the genoa car 10 and lead block 12. This causes the car 10 to always abut against the forward end 41 of the present invention. If the sailor rotates the rotatable shaft 62 and worm gear 80 causing the present invention to travel towards the stern of the sailboat, then the genoa car 10 will automatically follow and continue to abut because of the continuing tension placed upon it by the jib sheet 14 passed through the block 12.

It is intended that the sailboat will be equipped with at least one pair of the present invention mounted in a symmetrical mirror image fashion on the port side and the starboard side of the deck of the sailboat. The sailor will then have two separate jib sheets going to the clew of the jib sail, one being lazy. The sailor can adjust the jib sheet in one manner by using the present invention secured to the starboard side of the boat. He can use the other mirror image of the present invention on the port side of the boat to adjust the jib sheet sail on the port side of the boat when the boat is on its representative tack.

The materials used to fabricate the invention can be machined from basic aluminum or any type of salt water friendly metal, alloy or plastic. Additionally the track is made of standard of the industry aluminum to handle the repeated interaction between the worm gear 80 and the force placed upon the worm gear by the jib sheet 14 and the block and car 10.

For example, whenever there is no tension on the jib sheet 14, or lazy sheet, the present invention can be adjusted rapidly by removing the locking pin 90 to allow the openable and closable housing 52 to pivot open and then to manually move the present invention to the nearest proper location along the track 100 and then to close the housing 52 and reinsert the locking pin 90 to hold the invention back in its locked position. The track is secured to the deck or mounted on top of a conventional track with screws 108.

The present invention could be modified to eliminate the car 10 and to mount the hook 114, or any type of connection, at the forward end of the carriage. The depressed area between the knuckles 32 and 34 would be built up to provide a securement point where the hook 114 or similar anchor means could be mounted. The block 12 would then be connected to the hook and mounted directly on the present invention.

It is to be understood that the present invention is not limited to adjustment of the jib sheet. It could be used as a spinnaker pole adjuster, for example. The marine applications of the present invention are numerous.

While the present invention has been shown and described herein in what is conceived to be the best mode contemplated, it is recognized that departures may be made therefrom within the scope of the invention which is therefore not to be limited to the details disclosed herein but is to be afforded the full scope of the invention.

What is claimed is:

1. A transporter unit comprising:

a slidable carriage having a top, a bottom, a pair of sides, and a pair of transverse ends;

an openable and closable housing pivotably secured to said top of said carriage, and having a mounting means for mounting a rotatable shaft;

pivot pin means for pivotally securing said openable and closable housing to one of said sides of said slidable carriage;

a rotatable shaft positioned in said mounting means on said openable and closable housing;

worm gear means having a concentric bore, said worm gear means being positioned on said rotatable shaft by having said shaft aligned in said concentric bore of said worm gear means;

means for securing said worm gear means to said rotatable shaft so that both can rotate in unison;

locking and release pin means for locking said openable and closable housing to said carriage when said transporter unit is in operation, and for releasing said housing for rapid adjustment of the transporter unit;

an opening in said top of said carriage having sufficient dimensions to allow said worm gear means access to an area below said transporter unit.

2. The transporter unit as recited in claim 1 further comprising:

track means secured to the deck of a boat for allowing said slidable carriage to slide back and forth thereon;

said carriage having a channel means in said bottom of said carriage for cooperating with said track means;

whenever said openable and closable housing is locked to said carriage by said locking and release pin means, said worm gear means being pressed against said track for engaging said track and causing said transporter unit to move on said track whenever said rotatable shaft and worm gear means combination is rotated.

3. The transporter unit as recited in claim 2 including:

gear grooves on said track means for cooperating with said worm gear means thereby allowing said transporter unit to move back and forth on said track in response to said shaft being rotated with a turning device means.

4. The transporter unit as recited in claim 2 further comprising:

said openable and closable housing having a transverse cavity on its underside which faces said top of said carriage when said housing is in the closed position;

said cavity forming a forward brace and an aft brace on said openable and closable housing;

a common bore passing through said aft brace and terminating in said forward brace for allowing said rotatable shaft to be mounted therein;

said shaft having a keyway cut into its surface;

said bore of said worm gear having a keyway;

said rotatable shaft having said keyway on its surface alignable with said keyway in said bore of said worm gear;

key means positioned in said shaft keyway and said worm gear keyway for locking said worm gear onto said shaft to allow said shaft and said worm gear to rotate in unison;

said worm gear positioned and mounted in said cavity on said openable and closable housing by said rotatable shaft;

a washer mounted at either end of said worm gear on said shaft and between said braces for allowing said shaft and worm gear to rotate smoothly;

retaining collar means mounted on said shaft to lock said shaft and worm gear in said openable and closable housing.

5. The transporter unit as recited in claim 1 further comprising:

car means placed adjacent to said transporter unit;

said car having a locking means for locking said car on said track;

a genoa block mounted on said car.

6. The transporter unit as recited in claim 1 including:

means for demountably attaching to an end of said shaft for rotating said shaft to move the unit.

7. A transporter unit mounted on a track for adjusting a jib sheet comprising:

a slidable carriage having a top, a bottom, a pair of sides, and a pair of transverse ends;

an openable and closable housing pivotably secured to said top of said carriage, and having a mounting means for mounting a rotatable shaft;

pivot pin means for pivotally securing said openable and closable housing to one of said sides of said slidable carriage;

a rotatable shaft positioned in said mounting means on said openable and closable housing;

a worm gear having a concentric bore, said worm gear being positioned on said rotatable shaft by having said shaft aligned in said concentric bore of said worm gear;

means for securing said worm gear to said rotatable shaft so that both can rotate in unison;

locking and release pin means for locking said openable and closable housing to said carriage when said transporter unit is in operation, and for releasing said housing for rapid adjustment of the transporter unit; and an opening in said top of said carriage having sufficient dimensions to allow said worm gear access to the track.

* * * * *